United States Patent [19]

Garzon

[11] 4,268,733

[45] May 19, 1981

[54] LIQUID $SF_6$ PUFFER TYPE CIRCUIT INTERRUPTER

[75] Inventor: Ruben D. Garzon, Malvern, Pa.

[73] Assignee: Gould Inc., Rolling Meadows, Ill.

[21] Appl. No.: 843,573

[22] Filed: Oct. 19, 1977

[51] Int. Cl.[3] ..... H01H 33/88

[52] U.S. Cl. ..... 200/150 G; 200/148 A

[58] Field of Search ..... 200/150 G, 148 A

[56] References Cited

U.S. PATENT DOCUMENTS

| | | | |
|---|---|---|---|
| 2,572,406 | 10/1951 | Stulz | 200/150 G |
| 2,666,118 | 1/1954 | Ludwig et al. | 200/150 G |
| 3,406,269 | 10/1968 | Fischer | 200/150 G |
| 3,987,261 | 10/1976 | McConnell | 200/148 A |

FOREIGN PATENT DOCUMENTS

| | | | |
|---|---|---|---|
| 664900 | 9/1938 | Fed. Rep. of Germany | 200/150 G |

*Primary Examiner*—Robert S. Macon

*Attorney, Agent, or Firm*—Ostrolenk, Faber, Gerb & Soffen

[57] ABSTRACT

A high voltage, high power circuit interrupter uses liquid $SF_6$ in a puffer type arrangement. The cooperating contacts are surrounded by a nozzle and an upstream and a downstream piston, which are moved by a constant force-operating mechanism, move liquid $SF_6$ between the cooperating contacts when they separate, in order to interrupt the arc between the contacts. The interrupter requires a relatively low volume of $SF_6$ and a constant pressure is generated in the liquid during interruption. The interrupter ratings are adjusted by varying the differential pressure across the nozzle, and by changing the base-operating pressure.

11 Claims, 8 Drawing Figures

FIG. 3.
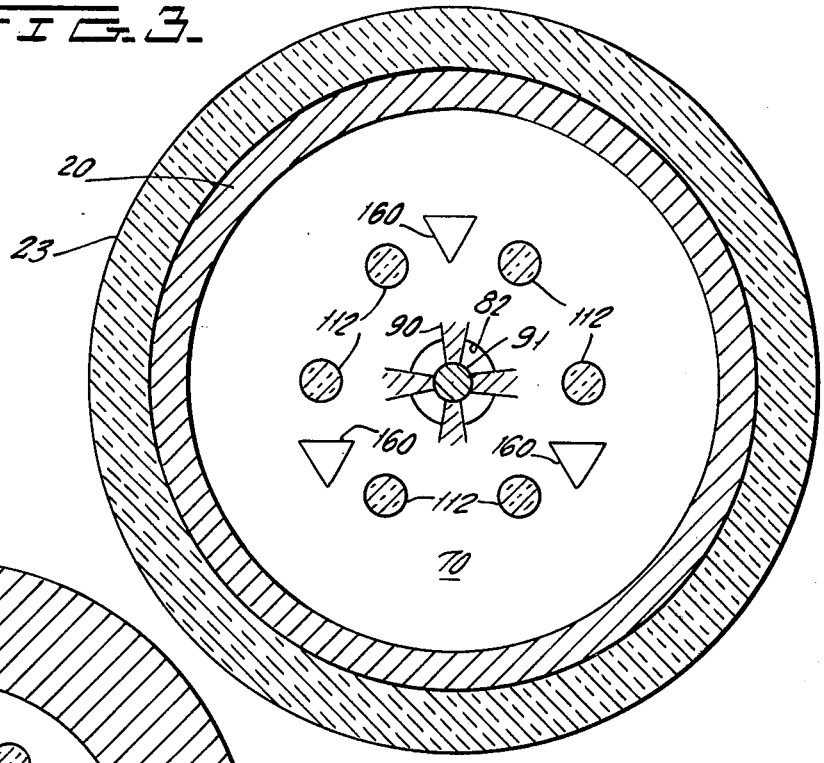
FIG. 2.
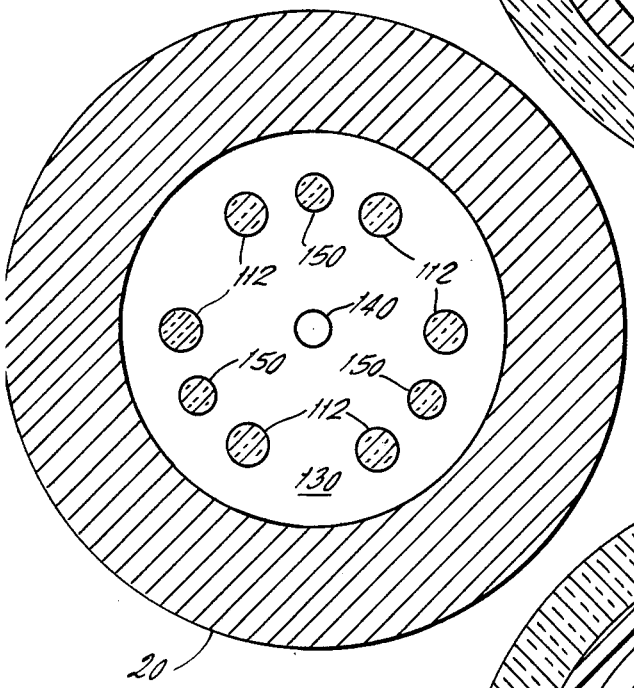
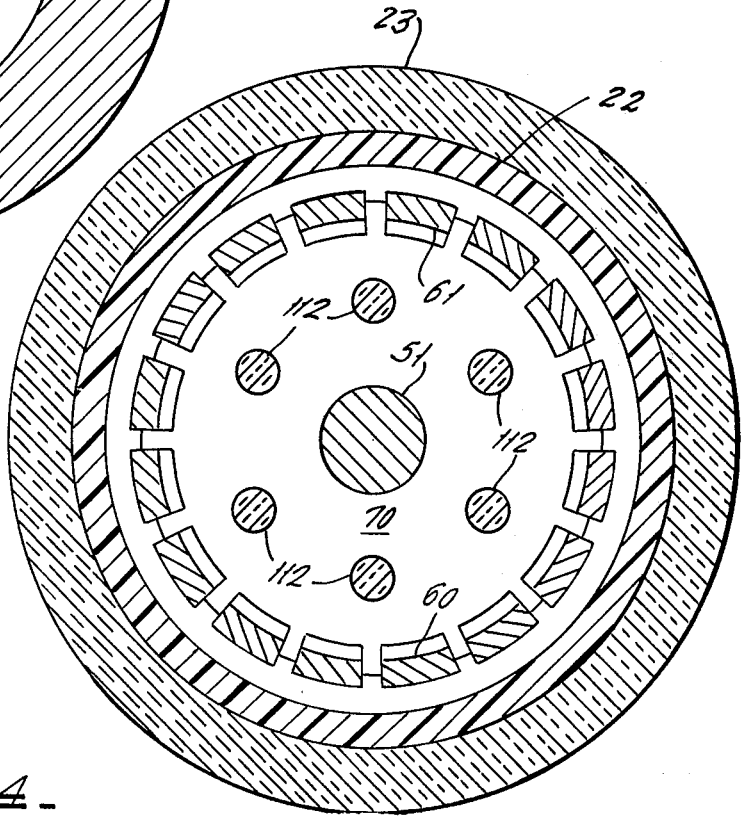
FIG. 4.

LIQUID $SF_6$ PUFFER TYPE CIRCUIT INTERRUPTER

RELATED APPLICATIONS

This application is related to copending application Ser. No. 731,421, filed Oct. 12, 1976 [C-1817(ER)], in the name of Lorne D. McConnell, and entitled "AXIAL BLAST PUFFER INTERRUPTER WITH MULTIPLE PUFFER CHAMBERS".

BACKGROUND OF THE INVENTION

This invention relates to high voltage, high power circuit interrupters and more specifically relates to an interrupter of the puffer type and which uses a relatively low volume of liquid $SF_6$ as an interruption medium.

High voltage, high power circuit interrupters using $SF_6$ gas blast principles for arc interruption are well known and are in general use in electrical utilities. one popular form of an $SF_6$ gas blast interrupter uses a two-pressure system design in which high-pressure $SF_6$ is released to flow through the separating contacts of the interrupter and into a relatively low-pressure region during interruption. This type device requires auxiliary equipment for compressing the gas and monitoring the operating pressures. The operating pressures of the two-pressure system are also limited by the dew point of the gas and, in most cases, external heaters are needed to prevent liquefaction of the $SF_6$ gas. These constraints on operating pressure limit the performance of the interrupter since interrupting performance is improved and higher interrupting ratings can be achieved by increasing the pressure both upstream of the contacts and downstream of the contacts.

To eliminate the need for a dual-pressure system, and in many instances the need for external heaters, it is possible to use an $SF_6$ puffer type breaker in which $SF_6$ gas is moved through the separating interrupter contacts by a piston type device which moves with the movable interrupter contact element. In a puffer type device, however, only moderate pressure differentials can be obtained if the operating mechanism is to be of a practical design, so that the interrupting capability of the gas type $SF_6$ puffer interrupter is limited. In addition, the interrupting time of a puffer type interrupter is relatively long because relatively long strokes are needed to effect the necessary gas compression. One puffer device which is of this type, but which uses a compression and a decompression gas chamber on opposite sides of the nozzle, is shown in U.S. Pat. No. 3,987,261, in the name of McConnell, dated Oct. 19, 1976.

The use of liquid sulfur hexafluoride for circuit interruption purposes has been contemplated in the past. However, problems of cavitation and the like have limited the usefulness of these devices. One patent disclosing the use of liquefied sulfur hexafluoride for a circuit interrupter is U.S. Pat. No. 4,009,358. This patent teaches the use primarily of a single piston in which the $SF_6$ liquid on one side of the piston communicates with the other side of the piston over a relatively long path.

BRIEF DESCRIPTION OF THE INVENTION

In accordance with the present invention, $SF_6$ in the liquid phase is used as the interrupting medium of a puffer type interrupter in which there is an upstream and downstream piston on opposite sides of the contacts which define a constant, but relatively low, volume of liquid $SF_6$ which is moved through the contacts at high speed during circuit interruption. Thus, the volume downstream of the nozzle is used as a decompression chamber which is coupled to a compression chamber upstream of the nozzle. This arrangement is now capable of producing very high pressure differentials across the interrupting region for the same work requirements of the conventional gas puffer design. That is, since $SF_6$ is practically incompressible in the liquid form, when the compression chamber decreases in volume and the decompression chamber increases in volume, the pressure drop across the interruption region becomes substantial after relatively small movement of the operating mechanism and the liquid moving pistons.

The interrupting capability of the novel interrupter is greater than that of gas $SF_6$ interrupters because of the high density of the liquid $SF_6$ contained downstream of the puffer nozzle which, as previously stated, improved the interrupting capability of the interrupter.

Thus, the interrupter of the invention will use a limited amount of liquid $SF_6$ which is contained within a sealed high pressure chamber. It will have higher interruption capability and shorter operating time than present gaseous $SF_6$ puffer devices and will be more economical and simpler than the present two pressure $SF_6$ gas interrupters.

The novel device of the invention also has a novel pressure compensation feature which tends to maintain a constant differential pressure across the nozzle of the device. Thus, if the downsteam pressure increases due to arc energy input, the piston will be accelerated, thus increasing the upstream pressure. This will then tend to maintain a constant differential pressure across the nozzle. This feature can be further enhanced by using different diameter pistons thus creating a net area differential that can develop balancing forces acting on the moving pistons.

The device of the invention may also be built in a modular fashion, since several different current ratings can be accommodated by changing the differential pressure across the nozzle, and different voltage ratings can be accommodated by control of the base-operating pressure.

In summary, some of the advantages of the present invention are:

1. A reduced operating time which permits the operation of the puffer type interrupter for a two-cycle breaker.
2. The necessary work and energy of the operating mechanism is reduced.
3. The device is capable of modular application wherein the same structure, with only different pressures, can be used for different current and voltage ratings.
4. Only a limited sealed volume of liquid $SF_6$ is needed.
5. The device automatically regulates the pressure differential across the nozzle.

BRIEF DESCRIPTION OF THE DRAWINGS

FIG. 2 is a cross-sectional view of FIG. 1 taken across section lines 2—2 in FIG. 1.

FIG. 3 is a cross-sectional view of FIG. 1 taken across section lines 3—3 in FIG. 1.

FIG. 4 is a cross-sectional view of FIG. 1 taken across section line 4—4 in FIG. 1.

DETAILED DESCRIPTION OF THE DRAWINGS

Figure 1:
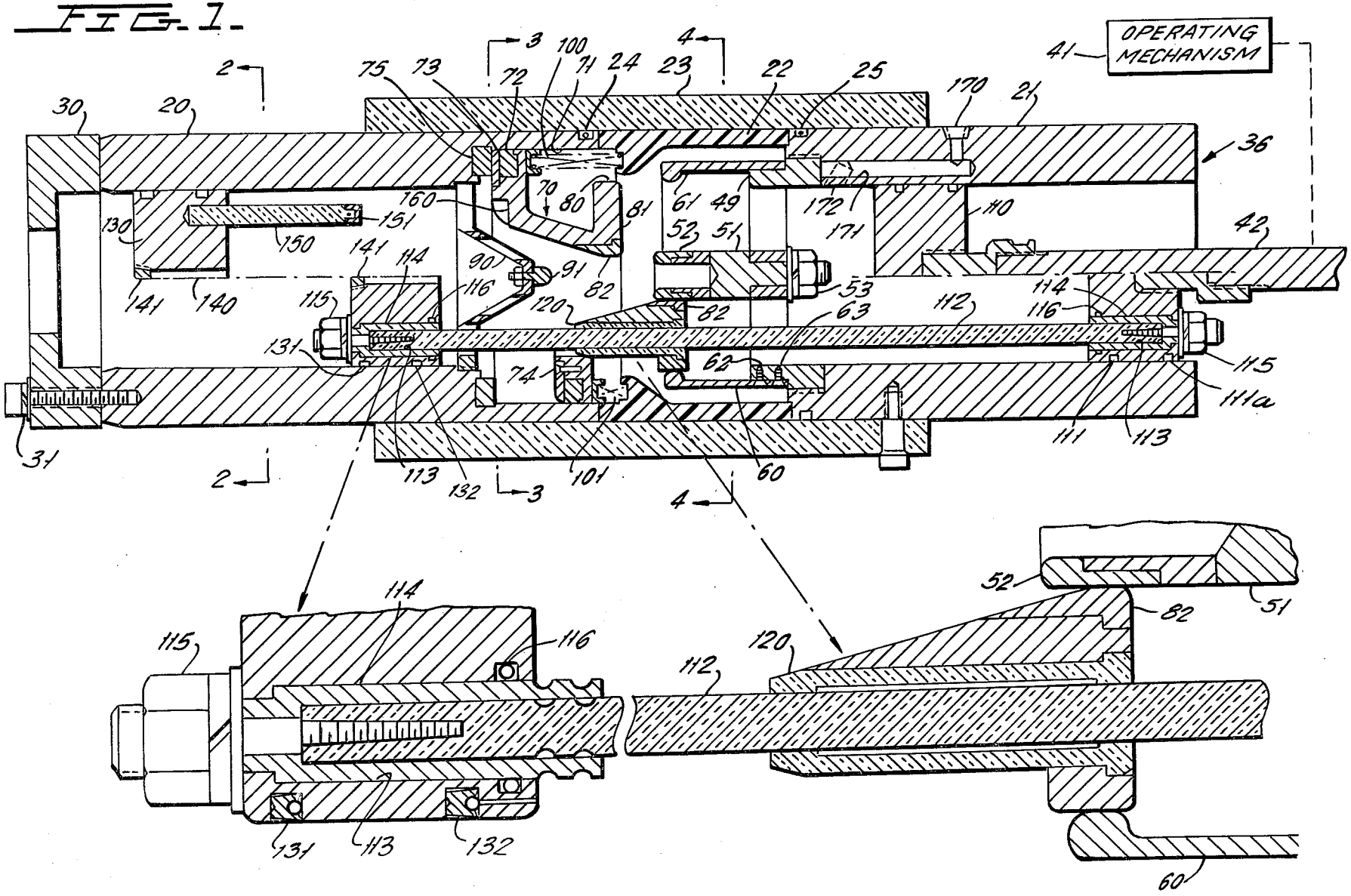
FIG. 1 is a cross-section taken through the axis of a preferred embodiment of the invention, wherein the view above the center line shows the contacts open while the view belwo the center line shows the contacts closed.
Figure 7:
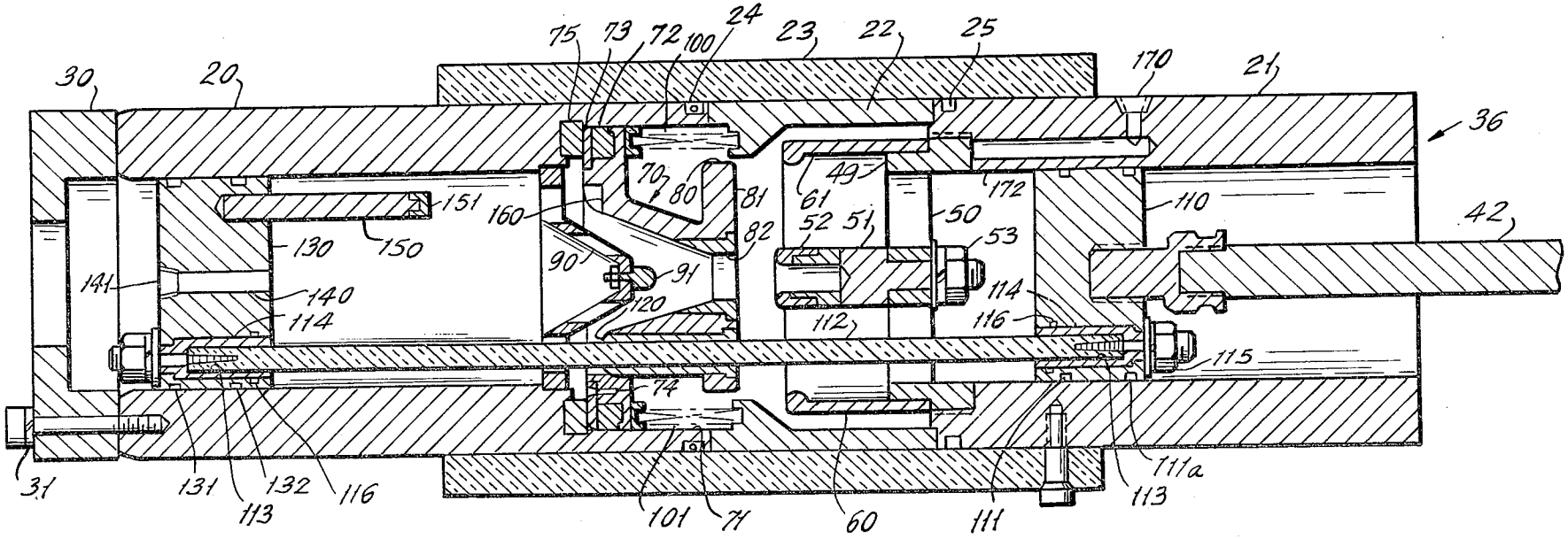
FIGS. 7 and 8 show the cross-sectional view of FIG. 1, in the open position and in the closed position, respectively.
Figure 8:
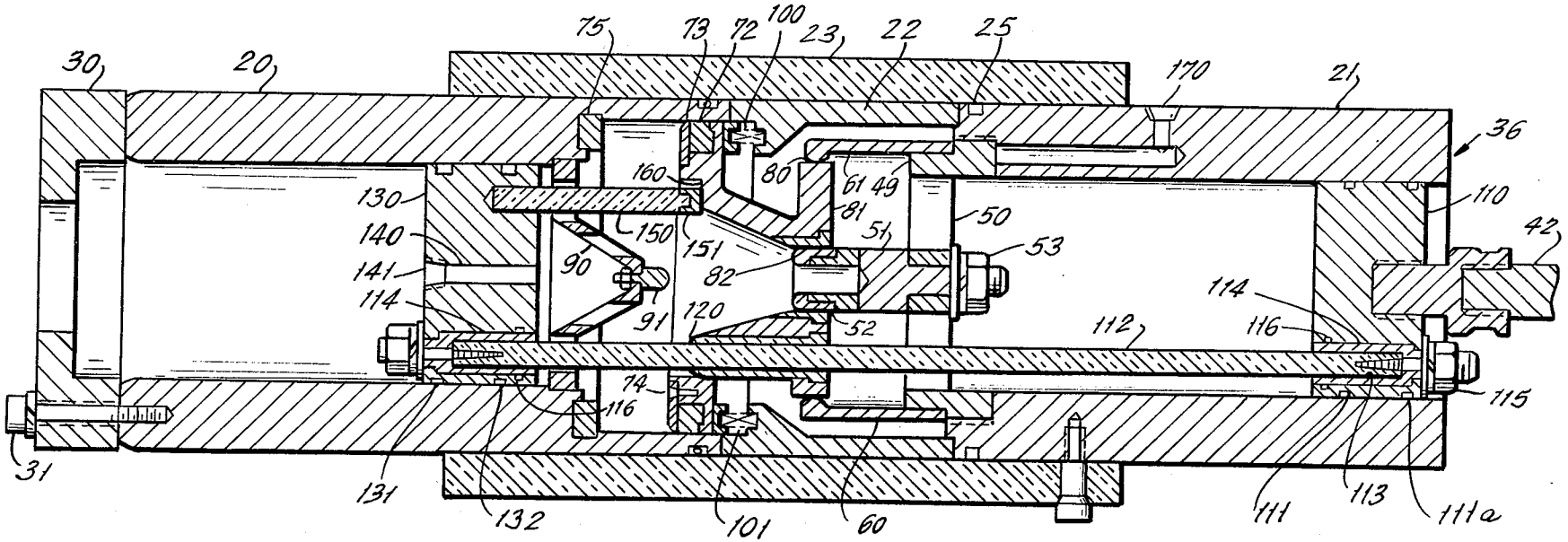

Referring to the drawings, in particular FIGS. 1, 7 and 8, the device housing consists of spaced aluminum cylinder sections 20 and 21 which capture an insulating spacer 22 between them. Specifically, spacer 22 is a cast cycloaliphatic resin. A tube 23 of insulation material and, preferably, a glass filament-wound tube encloses tubes 20, 21 and 22 and is sealed to tubes 20 and 21 by O-ring seals 24 and 25, respectively.

The end of tube 20 has an aluminum cap 30 bolted thereto which carries a terminal 31, which can be the first terminal of the interrupter. The end of tube 21 can act as the second terminal of the interrupter.

An operating mechanism is schematically illustrated as mechanism 41 connected to steel-operating shaft 42. Shaft 42 is moved by operating mechanism 41 between the interrupter-open position shown above the center line in FIG. 1 to the right-hand interrupter-closed position shown below the center line. Operating mechanism 41 may be of any desired well known type mechanism and could be solenoid-operated, spring-operated, hydraulically-operated, or pneumatically-operated, or the like.

A stationary main contact disk 49 of copper is fixed to aluminum tube 21 and consists of a spider disk having a central body 50. A central stationary arcing contact body 51 having a copper tungsten tip 52 is fixed to central body 50, as by bolt 53. The outer diameter of disk 49 then receives a plurality of main stationary contact fingers shown as fingers 60 and 61 in FIG. 1, but including a circular cluster of identical fingers as shown in FIG. 4. Each of the contact fingers may be held on disk 49 as by screws, such as screws 62 and 63, shown in FIG. 1 for contact finger 60.

The movable contact of the system consists of copper contact disk 70 which is axially slidably mounted within the increased internal diameter region 71 of tube 20. A sliding copper contact ring insert 72 of any suitable type makes sliding contact with internal diameter 71. Ring 72 is held in place by brass plate 73 which is fixed by screws, such as screw 74. Note that a rubber bumper 75 is fixed within tube 20 and is struck by plate 73 when the contact 70 reaches its open position.

A second main contact surface 80 is provided on disk portion 81 of contact 70 and surface 80 makes high pressure sliding engagement with contact fingers 60, 61 and the others of the stationary contact finger cluster when the contacts are closed. The inner diameter 82 of portion 81 consists of copper tungsten, and makes sliding contact with the arcing contact tip 52 when the contacts are closed. Inner diameter 82 also forms the throat of a nozzle for guiding flow of fluid therethrough. Note that when the contacts open, the main contacts 60, 61 and surface 80 of contact 70 part before the arcing contact regions 82-52 part. Thus, all initial arcing is between the copper tungsten arcing contacts.

A fixed transfer arcing ring 90, consisting of a conical spider ring, is fixed to tube 20, and thus is connected to movable contact 70, and has a central arcing porjection 91. When the interrupter is operated, the arc drawn initially from arcing contact 52 to contact 82 will transfer from contact 82 to contact 91.

The movable contact 70 is normally biased to an open position by a plurality of compression springs, such as springs 100 and 101 shown in FIG. 1. These springs are compressed when the contacts are closed, as shown for spring 101 in FIG. 1 and, as will be later described, force the contact open when the operating mechanism relieves a force holding the contact 70 in its closed position.

An aluminum piston 110 (the upstream piston) is then slidably mounted within the tube 21 which serves as a cylinder for piston 110. Liquid seals 111 and **111*a* form a sliding liquid seal between piston 110 and tube 21 which are capable of withstanding pressures of the order of 3000 psi of liquid $SF_6$. Piston 110 is then fixed to steel-operating shaft 42** as shown.

A plurality of high-strength rods, which may be high-strength glass rods known by the trademark PERMALI are then fixed to piston 110, as shown for rod 112 in FIG. 1. Only one of these rods is shown in FIG. 1 to keep the drawing as clear as possible and, in actuality, six symmetrically disposed rods 112 are used as shown in FIGS. 2, 3 and 4.

Each of rods 112 can be secured as shown in FIG. 1 by swagging the end of rod 112 into a close tolerance hole 113 in a steel tube 114. The end of steel tube 114 is threaded and is secured by nut 115. An O-ring seal 116 forms a liquid seal between tube 114 and the opening in piston 110 which receives tube 114.

Each of rods 112 then extends through teflon guide tubes such as guide tube 120 in movable contact 70 and are secured to downstream aluminum piston 130. Piston 130 is slidable within the tube 20, which acts as its cylinder, and is scaled to tube 20 by sliding seals 131 and 132 which are identical to seals 111 and 112. The rods 112 are connected to piston 130 by the same fastening arrangement as that described for piston 110.

Piston 130 further contains a control base 140 which can receive a pressure-release valve 141, which can be set to release pressure at about 2000 psi. Piston 130 is further provided with three contact-operating rods 150 (FIG. 2), only one being shown in FIG. 1 for clarity. Each of rods 150 are of a suitable insulation material such as a PERMALI glass rod, and they have an aluminum cap 151 fixed thereto. Rods 150 then engage respective slots 160 (FIGS. 1 and 3), only one of which is shown in FIG. 1, in contact 70 when the piston is to the right in FIG. 1 (below the center line in FIG. 1). This forces contact 70 to the right and to an engaged position, and loads compression springs 100 and 101. Note that suitable clearance openings are provided in arcing cone 90 to allow passage of rods 150, and of rods 112.

The interior of the device, between pistons 110 and 130, is then filled with $SF_6$ in the liquid phase. The $SF_6$ may, for example, be at a pressure of 1000 psi and will, at that pressure, be in fluid phase, even at very elevated temperatures. Liquid $SF_6$ is loaded into the device through port 170 in tube 21. Port 170 in turn is connected to channel 171 and channel 172 to reach the volume between pistons 110 and 130.

It is now possible to describe the operation of the interrupter of the invention.

When the interrupter is closed, a current path is created from terminal 36, tube 21, contact disk 49, contact fingers 60, 61, contact surface 81 of movable contact 70, sliding contact 72, tube 20, member 30 and terminal 31.

In order to open the interrupter, the operating mechanism receives a suitable signal, and operating shaft 42 is moved rapidly to the left. This causes upstream piston 110 to move to the left, causing the volume to the right of nozzle 82 to reduce, and causes downstream piston 130 to move to the left, causing the volume to the left of nozzle 82 to increase. As piston 130 moves to the left, rods 150 move away from contact 70 and the compression springs 100, 101 move contact 70 to the left and toward an open position. At the same time, fluid $SF_6$ flows from right to left, through nozzle 82 and through the region between the separating contacts 70–49–51–52. Note that the fluid begins to move immediately with the movement of pistons 110 and 130 since it is essentially incompressible.

The main contacts 80 and 60–61 open first and without arcing. The arcing contacts 52–82 then open and an arc is drawn between them which is quickly transferred from contact 82 to contact 91. The arc is then subjected to the deionizing effect of the liquid $SF_6$ which sweeps through the arc due to motion of pistons 110 and 130.

The pressure drop across nozzle 82 remains relatively constant and a constant force-operating mechanism can be used. Thus, an increase in the downstream chamber between piston 130 and nozzle 82 will simply increase the rate of motion of piston 130 and thus piston 110 will increase the upstream pressure between piston 110 and nozzle 82.

Arcing time is reduced in the device of the invention since liquid $SF_6$ begins to flow immediately with the first movement of pistons 110 and 130, and only relatively little work and energy are needed from mechanism 41. It is apparent that the device needs only a limited and sealed volume of $SF_6$ in the liquid phase.

A single design can be used for a variety of current and voltage ranges by changing the differential pressure across the nozzle and the base-operating pressure, as desired.

Figure 5:
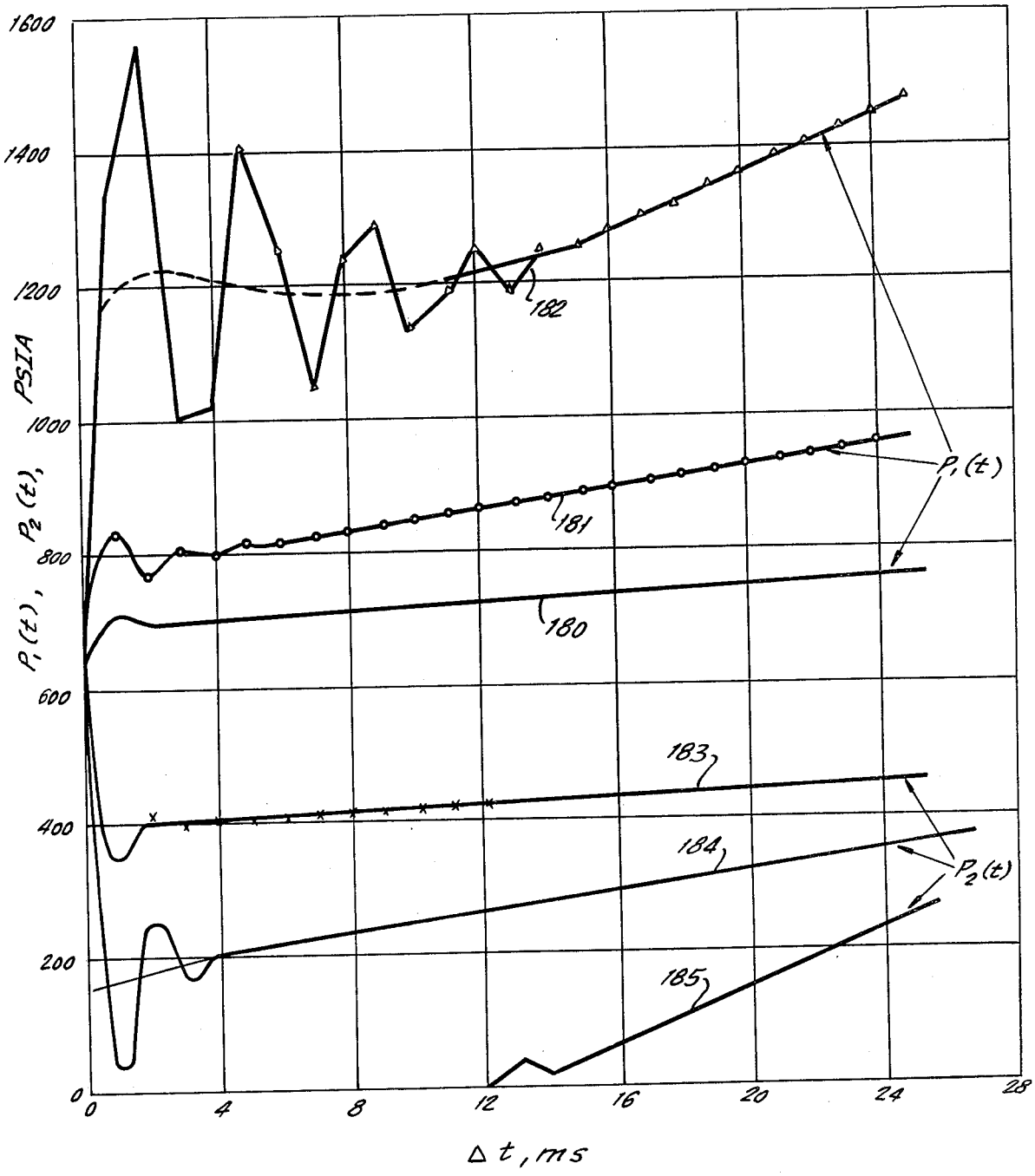
FIGS. 5 and 6 show characteristic curves of the device operation.

FIG. 5 shows plots of downstream pressure $P_2$ to the left of nozzle 82 and the upstream pressure $P_1$ to the right of nozzle 82 as a function of time and of a constant mechanism driving force. In FIG. 5, curves 180, 181 and 182 show pressure $P_1$ as a function of time for constant mechanism forces of 5900, 11,800, and 23,600 pounds, respectively. Curves 183, 184 and 185 show the downstream pressure for the same forces, respectively. Note the relatively constant pressure differentials of about 300, 600 and 1200 psi for the respective forces.

In these curves, the initial pressures $P_1$ and $P_2$ were 615 psi; the initial upstream volume was 140 cubic inches; the initial downstream volume was 50 cubic inches; the diameter of pistons 110 and 130 was each 5.0 inches; the movable mass weighed 8 pounds.

Figure 6:
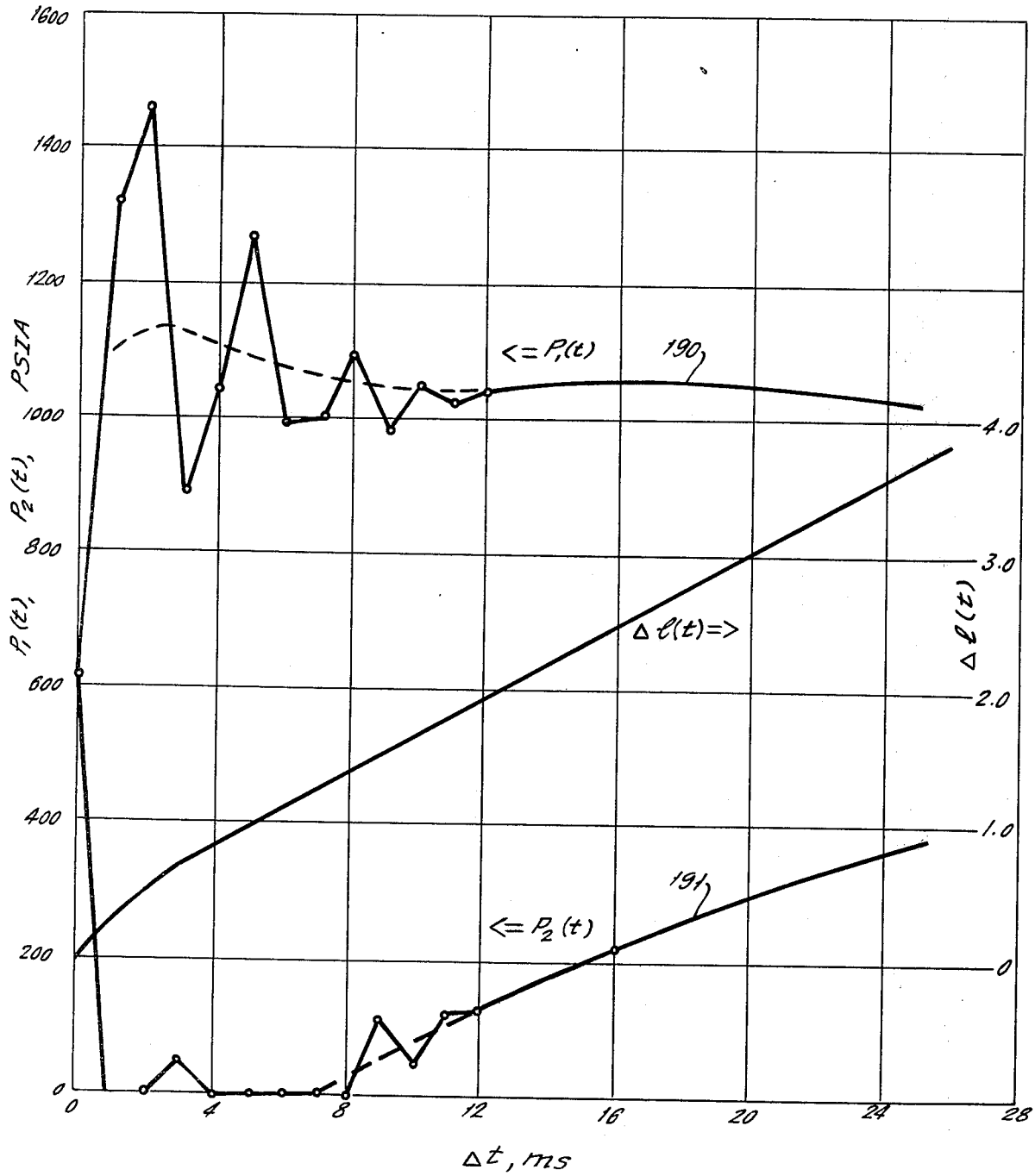

FIG. 6 shows the pressures $P_1$ and $P_2$ when the force from operating mechanism 41 is linearly decreasing according to the relation:

$$F = 23600 - 2950\Delta l(t)$$

where l(t) is the distance travelled by the pistons 110 and 130 as a function of time. Curve 190 shows the upstream pressure $P_1$, curve 191 shows the downstream pressure $P_2$ and curve 192 shows $\Delta l(t)$ over the total stroke distance of 4 inches. Again, a relatively constant pressure differntial is kept across nozzle 82.

Although a preferred embodiment of this invention has been described, many variations and modifications will now be apparent to those skilled in the art, and it is therefore preferred that the instant invention be limited not by the specific disclosure herein but only by the appended claims.

I claim:

1. A high voltage circuit interrupter comprising: a pair of cooperable contacts; nozzle means for defining a fluid flow path through the region between said cooperable contacts when said cooperable contacts open; cylinder means and first and second pistons disposed within said cylinder means; said first and second pistons disposed on respective opposite sides of said nozzle means for forcing fluid through said nozzle means; an operating means for moving said first piston toward said nozzle means and said second piston away from said nozzle means for forcing fluid located between said pistons through said nozzle means, said operating means also being for simultaneously opening said contacts; the amount of said fluid located between said pistons at all times filling the volume therebetween and remaining constant during circuit interruption; said fluid being $SF_6$ in the liquid phase; said piston being simultaneously movable by said operating means to produce a pressure differntial in said $SF_6$ between said pistons for causing said $SF_6$ to move through said nozzle means generally away from said first piston and toward said second piston, said pressure differential remaining substantially constant during circuit interruption; a housing for enclosing said cooperable contacts and said first and second pistons; and $SF_6$ in the liquid phase filling said housing.

2. The device of claim 1, wherein said first and second pistons and cylinder means define a first chamber upstream of said cooperable contacts and a second chamber downstream of said cooperable contacts respectively; said first and second chambers being filled with said $SF_6$ in the liquid phase; said first chamber beign increased in volume and decreased in volume when said second chamber is respectively decreased and increased in volume.

3. The device of claim 2, which includes elongated connection rods for connecting said first and second pistons to one another to be movable with one another.

4. The device of claim 2, which further includes spacer means surrounding said contacts to define a flow path for liquid $SF_6$ through said cooperable contacts as they open.

5. The device of claim 3, which further includes nozzle means surrounding said contacts when said contacts engage each other, to define a flow path for liquid $SF_6$.

6. A puffer type circuit interrupter; said puffer type circuit interrupter comprising a pair of separable contacts and first and second spaced pistons connected to a common opeating means and located on opposite sides of said separable contacts for forcing a fluid dielectric medium through the volume between said separable contacts during the opening of said separable contacts; the amount of said fluid medium located between said pistons at all times filling the volume therebetween and remaining constant during circuit interruption; said operating means being for simultaneously moving said first piston toward and said second piston away from said contacts to produce a pressure differential in said volume between said pistons for causing said fluid to move therethrough and through a region between said contacts and generally away from said first piston and toward said second piston, said pressure differential remaining substantially constant during circuit interruption; and said fluid medium consisting of $SF_6$ in the liquid phase.

7. The interrupter of claim 6, which includes means defining an upstream chamber which is upstream of said volume and means defining a downstream chamber which is downstream of said volume; said upstream and downstream chambers being filled with said $SF_6$ in the liquid phase; said operating means being operated for simultaneously reducing the volume of said upstream chamber and increasing the volume of said downstream chamber when said separable contacts are opened.

8. The interrupter of claim 7, wherein a flow-defining nozzle surrounds said volume between said contacts when said contacts engage each other.

9. A puffer type interrupter comprising: a pair of cooperable contacts; a flow-defining nozzle surroundign said pair of cooperable contacts when said contacts engage each other, to define a path for flow of a dielectric fluid through the region between said contacts when said contacts open; a first piston disposed on one side of said nozzle and defining a first sealed volume on said one side of said nozzle; a second piston connected to and movable with said first piston and disposed on the opposite side of said nozzle and defining a second sealed volume on said opposite side of said nozzle; said first and second volume communicating with one another through said nozzle; $SF_6$ in the liquid phase filling said first and second volumes; the amount of said $SF_6$ located between said pistons at all times filling the volume therebetween and remaining constant during normal circuit interruption; and operating means connected to said first and second pistons and to said cooperable contacts for opening said contacts and for simultaneously moving said first and second pistons so that the volume of said first sealed volume increases and the volume of second sealed volume decreases to establish a pressure differential between said first and second sealed volumes for causing said $SF_6$ to flow in a direction from said first to said second sealed volume, said pressure differential remaining substantially constant during normal circuit interruption.

10. The device of claim 9, which futher includes spring operating means connected to said cooperable contacts and operating said cooperable contacts in response to the movement of at least one of said first or second pistons.

11. The device of claim 1, wherein at least one of said cooperable contacts is a part of said nozzle means.

* * * * *